US006093119A

United States Patent [19]

Tipton

[11] Patent Number: 6,093,119

[45] Date of Patent: Jul. 25, 2000

[54] FOOTBALL TRAINING AND EVALUATION APPARATUS

[76] Inventor: Steven M. Tipton, 8801 S. 65th East Pl., Tulsa, Okla. 74133

[21] Appl. No.: 09/127,211

[22] Filed: Jul. 31, 1998

[51] Int. Cl.[7] ..... A63B 69/00

[52] U.S. Cl. ..... 473/438; 473/417; 473/221; 473/222; 473/441; 473/445; 473/422; 273/55 R; 273/65 R; 273/451; 434/247; 434/251; 73/379.01; 73/379.04; 482/54; 482/92; 482/900; 482/901; 482/902

[58] Field of Search ..... 473/438, 441, 473/417, 422, 445, 221, 222, 223; 273/65 R, 451, 55 R, 55 A; 434/251, 247; 73/379.01, 379.04, 379.09; 482/54, 92, 900, 901, 902

[56] References Cited

U.S. PATENT DOCUMENTS 4,534,557 8/1985 Bigelow et al. ..... 273/55 A X
4,890,495 1/1990 Slane ..... 73/379 X
5,152,733 10/1992 Farenholtz et al. ..... 482/135 X
5,474,290 12/1995 Rascona et al. ..... 273/55 R

*Primary Examiner*—Jessica J. Harrison
*Assistant Examiner*—Binh-An Nguyen
*Attorney, Agent, or Firm*—Frank L. Hart

[57] ABSTRACT

A football training and evaluation apparatus has a frame, a contacting element, and a force transferring member connected to the frame and the contacting element. A measuring-signaling element is connected to the force transferring member and is adapted to measure the force subjected on the force transferring member in response to an impact force subjected onto the contacting element and deliver a signal "S" responsive to said measurement. A visual signaling apparatus is connected to the frame and adapted to be actuateable and moveable in response to actuation.

17 Claims, 4 Drawing Sheets

FOOTBALL TRAINING AND EVALUATION APPARATUS

TECHNICAL FIELD

The subject invention relates to apparatus for training and evaluating football players. More particularly, the training and evaluation of blocking and/or tackling forces, and work, power, and quickness exerted by a football players.

BACKGROUND ART

One of the most difficult aspects of coaching football is the evaluation of the capabilities of the players. Heretofore, there has been little or no objective evaluation of the forces generated by the players and their reaction time. Subjective evaluation was generally based upon the sound of impact of the player hitting a blocking sled, the estimated speed of movement of the blocking sled, and reaction time was also merely an estimate.

It is therefore desirable to provide an apparatus which will quantitatively measure the initial force of impact during blocking and/or tackling, and/or the driving force, work, power, and/or the reaction time of the blocker to the snap of the football and/or the distance over which the force is applied. By obtaining such data, the player will have benchmark values upon which to improve. The coach will also have data for evaluating the players one against others and to evaluate each players rate of improvement.

The present invention is directed to overcome one or more of the heretofore problems, as set forth above.

DISCLOSURE OF THE INVENTION

In one aspect of the invention, a football training and evaluation apparatus is provided. The apparatus has a frame, a contacting element, and a force transferring member. The force transferring member is connected to the frame and to the contacting element. A measuring-signaling element is connected to the force transferring member and is adapted to measure an initial force imparted to the force transferring member in response to an impact force on the contacting element and deliver a signal "S" responsive to the measurement. A controlling element is provided for varying resistance to forces imparted to the contacting element after initial impact. A visual signaling apparatus is connected to the frame.

BEST MODE FOR CARRYING OUT THE INVENTION

Figure 1:
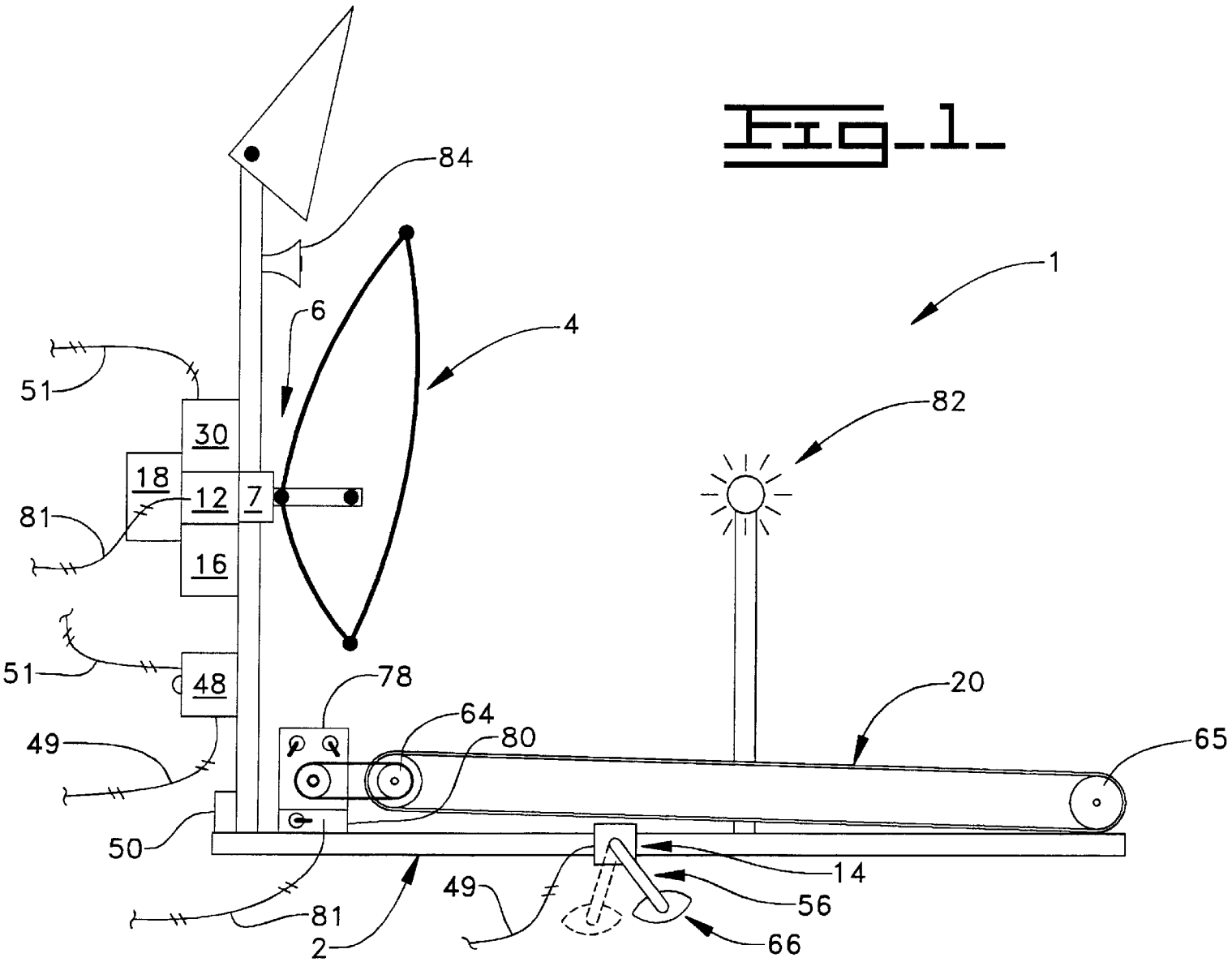
FIG. 1 is a diagrammatic side view of the preferred embodiment of the apparatus of this invention.
Figure 2:
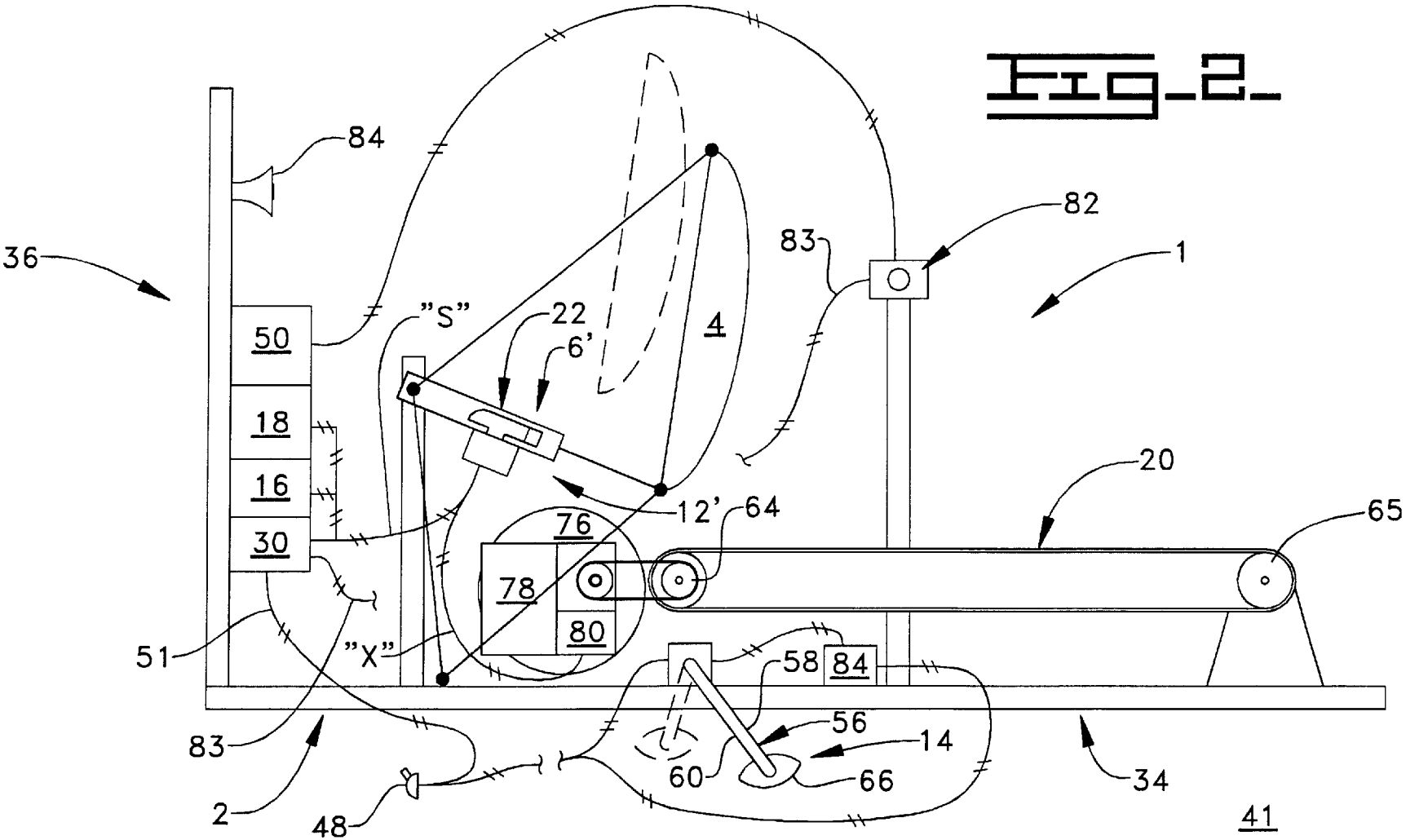
FIG. 2 is a diagrammatic side view of another embodiment of the apparatus of this invention.

Referring to FIGS. 1 and 2, the football training and evaluation apparatus 1 of this invention has a frame 2, a contacting element 4, and a force transferring member 6. The force transferring member 6 is connected to the frame 2 and the contacting element 4.

A measuring-signaling element 12 is connected to the force transferring member 6 and is adapted to measure the force imparted to the force transferring member 6 in response to an impact force on the contacting element 4. The measured force is delivered as a signal "S". A visual and/or audible signaling apparatus 14 is connected to the frame 2 and is adapted to be manually actuateable.

Preferably, a computer/recorder 16 is connected to the measuring-signaling element 12, receives signal "S", and displays, in readable form, the measurement of the force exerted by an individual on the contacting element 4. More preferably, the computer/recorder 16 has a printer 18 and is adapted to continuously record the magnitude of different forces subjected onto the contacting element 4.

In the preferred embodiment of FIG. 1, a treadmill 20, as is well known in the art, extends outwardly in front of the contacting element 4 and is of a construction for accommodating the body of a football player, being maintained stationary during initial impact of the player on the contacting element 4, releasable for movement in response to the measuring-signaling element 12 receiving an impact of a preselected magnitude, and being controllable for exerting programmable resistances against the leg drive of the football player, as hereafter more fully described.

In the preferred embodiment shown in FIG. 1, the preferred measuring-signaling element 12 is a force transducer having an output terminal and being operably connected to the computer/recorder 16.

It is preferred that a timer 30 be connected to the computer/recorder 16 and to the visual signaling apparatus 14 and be adapted to measure the period of time between actuation of the visual signaling apparatus 14 and the receipt of signal "S".

In a more sophisticated embodiment of the invention shown in FIG. 1, it is preferred that the printer 18 be connected to the measuring-signaling element 12 and adapted to receive signal "S" and continuously record the magnitude of forces subjected onto the contacting element 4.

Figure 3:
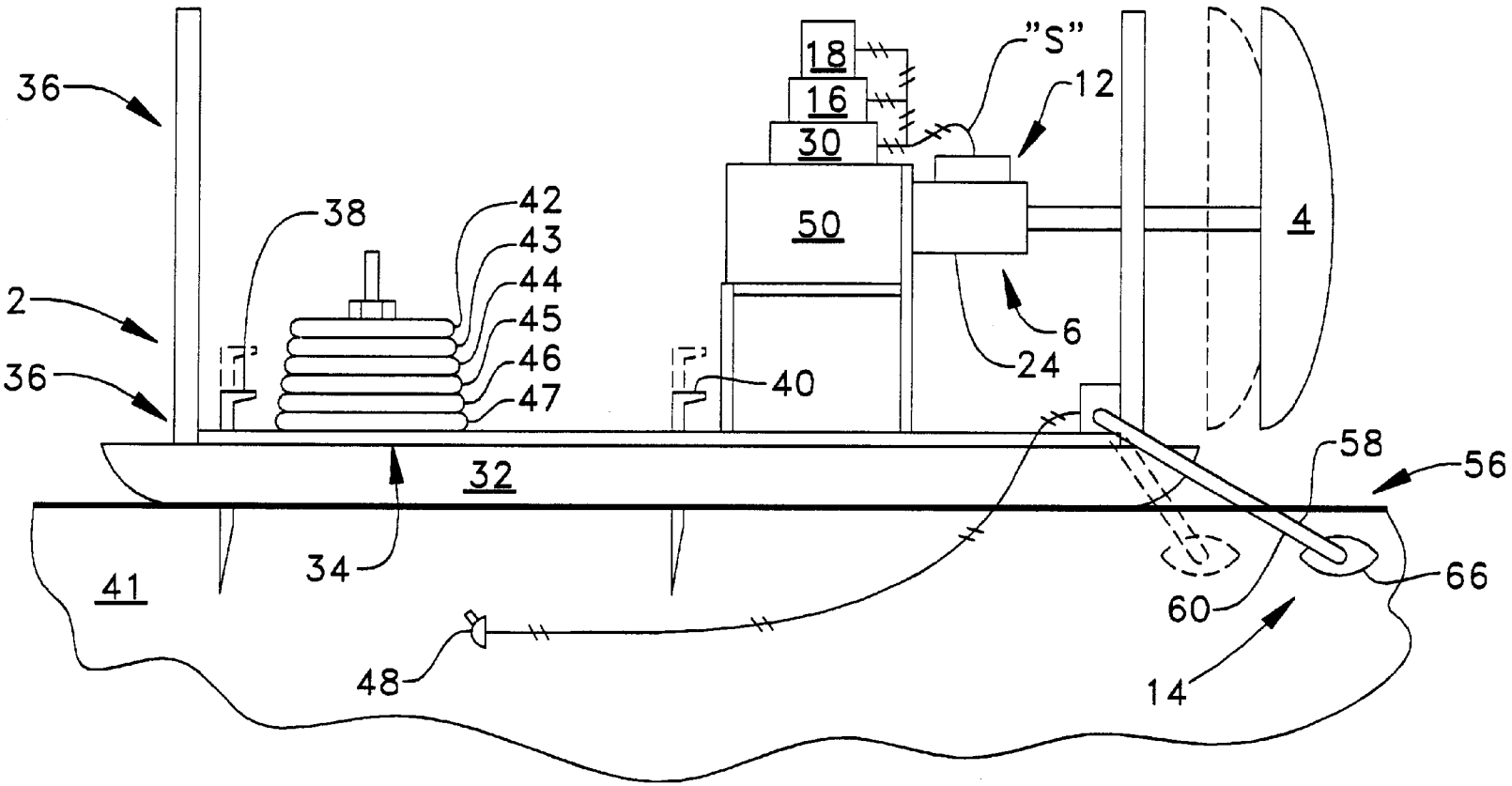
FIG. 3 is a diagrammatic side view of another embodiment of the apparatus that can be used outdoors.

FIG. 3 shows an alternate embodiment of the invention which can be utilized outdoors. A skid 32 is connected to a bottom portion 34 of the frame 2 and extending along the frame 2 in a direction away from the contacting element 4 and toward a rearward portion 36 of the frame 2.

As shown, a plurality of moveable holding elements 38,40 are connectable to the frame and are insertable into the ground and adapted to maintain the frame 2 stationary during impact on the contacting member 4. These holding elements 38,40 are positioned in the ground 41 when the apparatus 1 is used as an "impact only" evaluation/training device and are removed from the ground for adapting the apparatus 1 to slide along the ground on the skid 32 when the apparatus 1 us used to evaluate driving power of the user. When the apparatus 1 is used in the driving power mode, as hereafter more fully described, the apparatus 1 may include a plurality of weights 42–47 each individually connectable to the frame 2 for increasing and decreasing the difficulty of sliding the apparatus 1 along the ground.

In the preferred embodiment as shown in FIG. 1, the apparatus has an electric switch 48 connected to the visual signaling apparatus 14 and the timer 30 via respective lines 49,51. An electrical power source 50, such as a car battery or other electrical source, is provided and is connected to the electrical switch 48, the visual signaling apparatus 14, the time 30, the computer/recorder 16 and the printer 18. It will be obvious to one skilled in the art that the power source 50 can be 110 v. house current, which is preferred.

Referring to FIG. 3, another type measuring-signaling apparatus 14 is shown. In this embodiment, the measuring-signaling apparatus 14 has a spring 52 associated with means 54 for measuring spring deflection or compression in response to an impact force subjected onto the contacting element 4 and delivering a signal "s" responsive to the measurement. An example of such means 54 is a load cell constructed from strain gaged mechanical components with signal conditioning circuitry or piezoelectric transducers, as are well known in the art.

Figure 4:
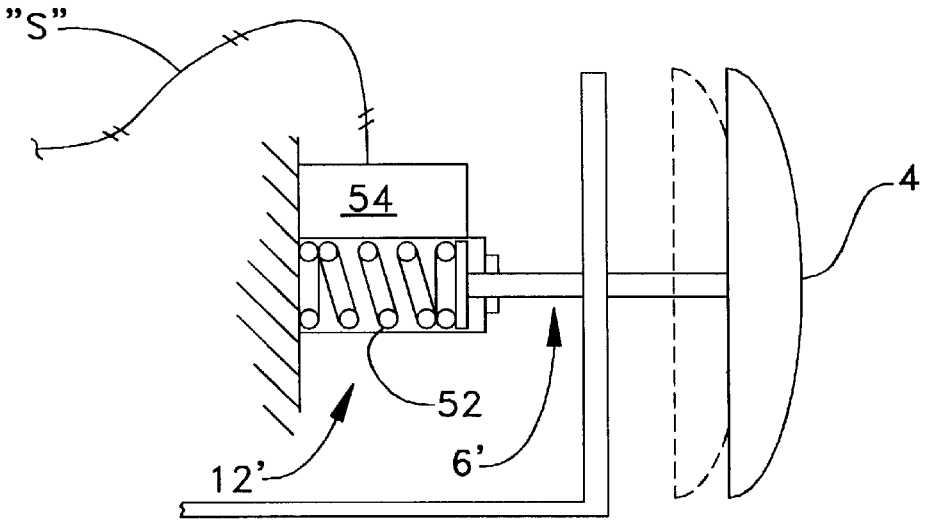
FIG. 4 is a diagrammatic side view of another embodiment of the measuring-signaling element of this invention.
Figure 5:
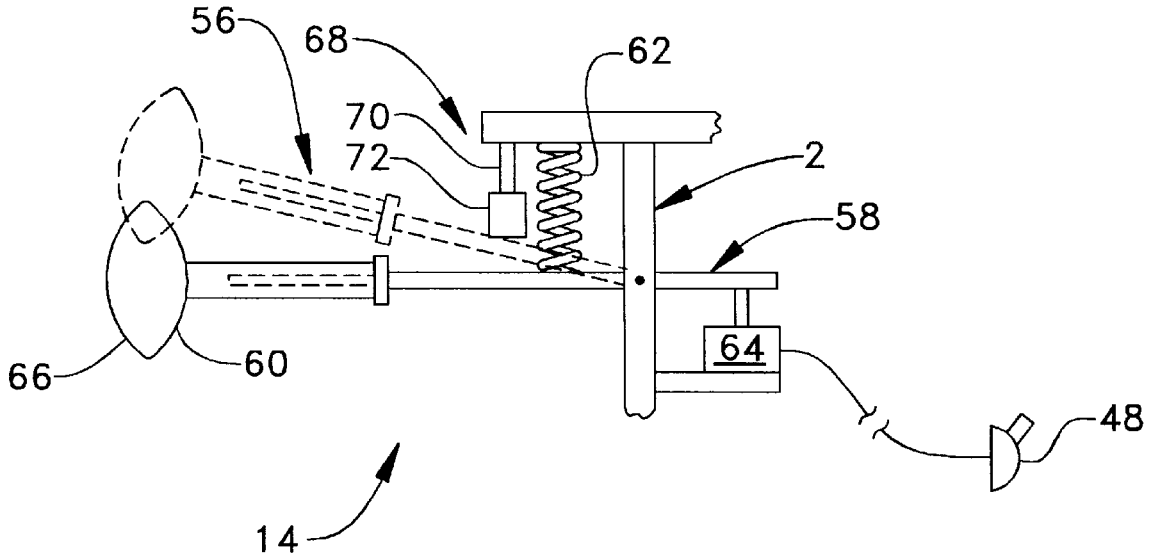
FIG. 5 is a diagrammatic top view of the signaling apparatus of this invention.

Referring to FIG. 4, a top view of the visual signaling apparatus 14 is shown. In this preferred embodiment, an elongated member 56, such as a segmented rod or telescoping system, has first and second end portions 58,60. The first end portion 58 is pivotally connected to the frame 2 and is installable on preselected sides of the frame 2 and is moveable between a first position, shown by solid lines (FIGS. 1–3), and a second position, shown by broken lines. As shown, the elongated member 56 extends substantially horizontally and laterally from the frame 2 in close proximity to the ground 41. A spring 62 is connected to the frame 2 and to the elongated member 56 and biases the elongated member 56 toward the second position.

A trigger 64 is connected to the elongated member 56 and the frame 2 and is adapted to release the elongated member 56 at the first position (shown) for movement to the second position. The trigger 64 can take many different mechanical forms without departing from this invention. In the preferred embodiment, it is desired that the trigger 64 be an electrically actuateable solenoid associated with the electrical switch 32 for remote actuation by a coach, for example, which will be later described in greater detail. A target element 66, preferably of football configuration, is connected to the second end portion 60 of the elongated member 56. As stated above, the visual signaling apparatus 14 can be connectable to either side of the frame 2.

A mechanical stop 68, is preferably provided and is connected to the frame 2 for controlling the length of travel of the target element 66 in its movement from the first to the second position. More preferably, the stop means 68 is infinitely variable, and for example, are first and second threaded members 70,72, threadably connected to one another with one of the members 70/72 being fixedly connected to either the frame 2 or the elongated member 56. It should be understood that the target element 66 can be of other construction, such as a light or other visual display, without departing from this invention.

The control means 78 is adapted to regulate the magnitude of force required to be imparted to the treadmill 20 by a user to cause the treadmill to rotate about its rollers 64,65. The control means 78 is controllable by the operator to preset a break-away force that requires the user to impart a desired magnitude of force in order to generate initial rotation of the treadmill 20 and a preset rotation force that resists the leg drive of the user after initiation of treadmill rotation.

The treadmill 20 also has an actuator 80 connected to the measuring-signaling element 12 via line 81. In the operation of the apparatus of FIG. 1 of this invention, the treadmill 20 is actuated for rotation only in response to the actuator 80 receiving a signal "X" from the measuring-signaling element 12 responsive to a force greater than a preselected magnitude being imparted to the contacting element 4. In a preferred embodiment of this apparatus, the actuator 80 is variably controllable for requiring a multitude of different magnitudes of signal "X" to initiate release and rotation of the treadmill 17.

A preferred option, that can be incorporated into the embodiment of FIG. 1 of this invention, is a default element 82 that will signal and/or terminate operation of the apparatus 1 in response to the football player moving toward the contacting element and past a preselected location prior to movement of the visual signaling apparatus 14. In other words, the football player being off-sides.

The default element 82 is preferably an electric eye system, as is well known in the art, and is positioned to detect an object in the zone of the target element 66 prior to actuation of the target element 66. Although the target element 66 is preferably in the shape of a football, it should be understood that the target element 66 can be any visual signaling element such as a light, led, or video display.

In a more advanced apparatus, the default element 82 and the visual signaling apparatus 14 can be associated with an audio system 84 through which snap signals are broadcast and coordinated with the actuation of the visual signaling apparatus 14. Use of this more advanced automatic option can be used to train the football players to not only avoid off-side penalties responsive to irregular snap counts of a quarterback, but can be used in the training of offensive players to gain the greatest anticipation of the snap count without being off side.

It should be understood that the apparatus of this invention can be constructed of various other elements than those described without departing from this invention. For purposes of simplicity, examples of such alternative elements are listed as follows:

- The force transferring member 6 is preferably an electro-mechanical load cell 7 (FIG. 1), but can be a strain gage system, a hydraulic or pneumatic pressure transducer system 22 (FIG. 2), or a mechanical spring system 52 (FIG. 3) without departing from this invention.
- The Visual and/or audible signaling apparatus 14 is preferably an electro-mechanical solenoid or relay, but can be an LCD panel, video screen, light bulb or LED.
- The weights 42–47 are preferably preformed metal weights, but can be bags of weighting material or tanks containing water.
- The control means 78 can be associated with the roller 64 of the treadmill 20 (FIG. 1) or to a flywheel 76 (FIG. 2). Various means known in the art can be used to resist motion of the treadmill 20, for example, eddy current forces, magnetic forces, frictional forces, centrifugal forces, or fluids, among others.

INDUSTRIAL APPLICABILITY

As set forth above, the apparatus of this invention is provided for the training and evaluation of blocking and/or tacking of a football player. In the most preferred embodiment of this invention, a printed, continuous readout of forces subjected onto the contacting element 4 by a football player being trained is provided so that the coach will have printed data which he can take to his office and evaluate at his leisure.

Primarily the data obtained from impacts on the contacting element 4 will be the magnitude of the initial impact force, the time delay between actuation of the target element 66 and the impact, the continuously exerted forces subjected onto the contacting element 4 during leg drive of the individual after initial impact.

Referring to the embodiment of FIG. 3, where the coach is interested in evaluating the initial impact force of a blocker or tackler, the holding elements 38,40 can be inserted into the ground. In this arrangement, the deflection of the contacting element 4 during contact will "soften" the resistance against the football player and prevent personal injury while preventing the apparatus 1 from being moved around on the playing field.

Where the coach is interested in evaluating the driving force of a blocker or tackler, the holding elements 38,40 are spaced from the ground and the apparatus is adapted to slide along the ground on the skid 18 or skids under the weight limitations provided by the weight of the apparatus 1 plus the weights 26–31 added to the apparatus 1. If desirable, the embodiment of FIG. 3 can include a motion sensor, such as a wheel, for sensing and recording the motion of the sled. The sled type apparatus of FIG. 3 would then be capable of sense and record the motion of the sled which then could provide work and power readings as more fully described with regard to FIGS. 1 and 2.

Referring to the embodiment of FIG. 1 which is a stationary apparatus, the initial impact force and the forces of leg drive are automatically recorded. Further, the resistance to the leg drive of the individual can be infinitely altered via the control means 78 and defaults, such as the individual being off sides or exerting less than desirable initial contact, are automatically signaled.

Blocking training will generally be limited to what are known as "down" linemen, but the apparatus of FIG. 3 can be used by fullbacks and others who take a running start prior to blocking, and can be used to evaluate tackling forces generated by all of the trainees.

As is known in the sport, the reaction time of the football player is a most import aspect of training and evaluation. That reaction is often in response to the snap of the ball by the center. In the embodiment of this invention, the target element 66 can be actuated by the coach to move and responsively initiate timing of the period between target movement and the initial impact. Preferably, the timer will indicate the timed period in thousandths of a second. By so providing such minute timing segments, the trainee will be provided with data upon which he can more easily set realistic goals to accomplish. It should also be understood that the target element 66 can be actuated by the user of the device. By providing a time delay element with the actuator, a user can train by himself on the apparatus by actuating the time delay element himself, getting in position to impact the contacting element, and then executing his block in response to movement of the target.

One aspect that should be noted, is the connection of the actuation switch 48 to the trigger 64 as being an electric line of considerable length. Obviously, the switch 48 can be mechanical and/or placed on the sled operated by a coach riding the sled. However, by providing the extended electrical line, the coach can view the trainee from various locations during training, there to detect and alter positions and movements of the individual for enhancing his performance. Furthermore, wireless technology can easily be implemented as an alternative without departing from this invention.

Such changes in a trainee's stance or movements are often not immediately accepted by the trainee for reasons of preference, comfort, habit or other aspects. However, where the trainee is able to obtain instantaneous data displaying that the change suggested by the coach did in fact improve performance, the change will generally be readily accepted by the player.

Further, the coach will learn from the data. Although there are accepted stances and movements that are believed to be the most efficient and produce the most desired results, individuals are each different. As training on the apparatus of this invention continues, it is expected that the coach will be able to readily adapt the stance and movements of the players on an individual basis and resultantly provide individual instructions which will gain the greatest results from each individual. It is also believed by the inventor that, since heretofore utilized evaluation methods were subjective, coaches using this apparatus may discover that some of their beliefs were in error.

Another aspect of the invention that is useful is the fact that the elongated member 56 containing the target 66 can be segmented or of telescopical construction and can be adjusted and moved to varying distances from the contacting element 4. It will be obvious to one skilled in the art, that such arrangement will be instrumental in training the various positions under more realistic conditions. For example, a defensive tackle is a different distance from the ball than is a guard. The variable aspect of the elongated member 56 will thus closely simulate actual playing conditions. This is particularly valuable in football training at a higher level where one week the distance from the ball from a tackle may be considerably different than the formation what will be chosen for next weeks opponent. Therefor, the adjustability of the device provides the player with practice using his peripheral vision.

It also should be understood that the visual signaling apparatus 14 is adapted to be placed on either side of the contacting element 4 to accommodate both left side linemen and right side linemen. The length of movement of the target element 66 is also adjustable in order to train the football players to initiate in response to the slightest movement of the ball.

In the operation of the apparatus, the coach or player actuates the switch 48 which in turn actuates the timer (where included), releases the trigger and causes the target element 50 to move and signal the football player to initiate his block or tackle. The initial impact of the player onto the contacting element 4 causes the moveable member 6 to move and deliver a signal indicating the force of the impact. That signal can be recorded in terms of pounds or other terms together with the time lag between actuation of the target element 66 and the impact. The signal also affects timing and records the period of time between actuation of the target and initial impact which is indicative of the quickness of the individual. The maximum force of the initial hit is recorded and, after break out of the treadmill, the force exerted by the user against the treadmill and the distance the treadmill is moved is recorded.

Therefore the data obtained from use of the apparatus can be expressed as quickness of the user in response to movement of the target, hitting force in response to initial impact on the contacting element, and horse power generated by the user's leg drive after or during initial impact.

The apparatus can be used inside or outside and can be used for coaches evaluation of a player or for conditioning and training of the player.

Other aspects, objects and advantages of tis invention can be obtained from a study of the drawings, the disclosure and the appended claims.

What is claimed is:

1. An apparatus for training and evaluating football players, comprising:

a frame;

a contacting element;

a force transferring member connected to the frame and to the contacting element;

a measuring-signaling element connected to the force transferring member and being adapted to measure an initial force imparted to said force transferring member in response to an impact force on the contacting element and deliver a signal "S" responsive to said measurement;

a controlling element for varying resistance to forces imparted to the contacting element after initial impact;

a visual signaling apparatus connected to the frame and being adapted to be manually actuatable;

an elongated member having first and second end portions, said first end portion being pivotally connected to a bottom portion of the frame and moveable between first and second positions, said elongated member extending laterally from said frame;

means for biasing the elongated member toward the second position;

a trigger connected to the elongated member and being adapted to release the elongated member for movement from the second to the first position, and a target element connected to the second end portion of the elongated member.

2. An apparatus, as set forth in claim 1, including a computer/recorder; and wherein the measuring-signaling element includes a force transducer having first and second ends, one end being connected to the frame, the other end being connected to the contacting element, said transducer being connected to the computer/recorder.

3. An apparatus, as set forth in claim 2, including a timer connected to the the computer/recorder and to the visual signaling apparatus and being adapted to measure the period of time between actuation of the visual signaling apparatus and the receipt of signal "S".

4. An apparatus, as set forth in claim 3, including an electrical switch connected the visual signaling apparatus and the timer and a power source connected to the electrical switch, the visual signaling apparatus, and the computer/recorder.

5. An apparatus, as set forth in claim 1, wherein the measuring-signaling element includes a load cell and means for measuring the force exerted on the load cell and delivering a signal "S" responsive to said measurement.

6. An apparatus, as set forth in claim 1, including means for controlling the length between the first and second positions of the elongated member as measured at the target element.

7. An apparatus, as set forth in claim 1, including a skid connected to a bottom portion of the frame and extending in a direction away from the contacting element toward a rearward portion of the frame.

8. An apparatus, as set forth in claim 7, including a plurality of weights each connectable to the frame.

9. An apparatus, as set forth in claim 7, including holding members connected to the frame and being insert able into the ground and being adapted to maintain the frame stationary during impacts on said contacting member.

10. An apparatus, as set forth in claim 7, including a printer connected to the measuring-signaling element and being adapted to receive signal "S" and continuously record the magnitude of forces subjected onto the contacting element.

11. An apparatus, as set forth in claim 1, wherein the visual signaling apparatus has a length that is variable.

12. An apparatus for training and evaluating football players, as set forth in claim 1, including:

a treadmill extending outwardly from the contacting element and being of a size sufficient for accommodating a football player.

13. An apparatus for training and evaluating football players, as set forth in claim 12, including:

means for maintaining the treadmill stationary during initial impact on the contacting element and releasable for movement in response to the measuring-signaling element receiving an impact of a preselected magnitude.

14. An apparatus for training and evaluating football players, as set forth in claim 13, including:

control means for exerting different programmable resistances against the leg drive force exerted on the treadmill by the football player.

15. An apparatus for training and evaluating football players, as set forth in claim 1, including:

a computer/recorder connected to the measuring-signaling element and being adapted to receive signal "S" and display in readable form, the measurement of the force exerted on the contacting element; and a printer connected to the computer/recorder and adapted to continuously record the magnitude of different forces subjected onto the contacting element.

16. An apparatus for training and evaluating football players, as set forth in claim 1, including:

default means associated with the visual signaling apparatus for indicating movement of the football player toward the contacting element prior to actuation of the signaling apparatus.

17. An apparatus for training and evaluating football players, as set forth in claim 1, including:

audio means coordinated with the triggering of movement of the target element, said audio means being adapted to broadcast snap signals.

* * * * *